US006739256B1

(12) United States Patent
Murakawa et al.

(10) Patent No.: US 6,739,256 B1
(45) Date of Patent: May 25, 2004

(54) METHOD OF INK AGITATION BY INK ASPIRATION

(75) Inventors: Ichiro Murakawa, Izumi (JP); Tadao Kubo, Wakayama (JP)

(73) Assignee: Umetani Mfg. Co., Ltd., Osaka (JP)

( * ) Notice: Subject to any disclaimer, the term of this patent is extended or adjusted under 35 U.S.C. 154(b) by 0 days.

(21) Appl. No.: 10/150,336

(22) Filed: May 17, 2002

(51) Int. Cl.[7] ..... B41F 31/08; B41F 31/03; B41F 31/20

(52) U.S. Cl. ..... 101/366; 101/350.5; 101/425; 101/DIG. 34

(58) Field of Search ..... 101/349.1, 366, 101/350.1, 350.5, DIG. 34, 207, 208, 210, 363, 425, 483, 401

(56) References Cited

U.S. PATENT DOCUMENTS

| | | | | | |
|---|---|---|---|---|---|
| 2,887,050 | A | * | 5/1959 | Moser et al. | 101/364 |
| 3,896,730 | A | * | 7/1975 | Garrett et al. | 101/425 |
| 3,974,768 | A | * | 8/1976 | Grobman | 101/425 |
| 4,480,548 | A | * | 11/1984 | Rebel et al. | 101/483 |
| 4,526,102 | A | * | 7/1985 | Grobman | 101/425 |
| 4,534,291 | A | * | 8/1985 | Sabota et al. | 101/483 |
| 5,003,877 | A | * | 4/1991 | Yano et al. | 101/363 |
| 5,265,535 | A | * | 11/1993 | Isowa et al. | 101/350.5 |
| 5,503,069 | A | * | 4/1996 | Blim | 101/216 |
| 5,697,299 | A | * | 12/1997 | Umetani et al. | 101/366 |
| 5,915,302 | A | * | 6/1999 | Baba et al. | 101/366 |

FOREIGN PATENT DOCUMENTS

| | | |
|---|---|---|
| EP | 0 950 521 | 10/1999 |
| EP | 1 138 487 | 10/2001 |
| GB | 2 262 716 | 6/1993 |
| JP | 05200986 | 8/1993 |
| JP | 06000947 | 1/1994 |
| JP | 06000987 | 1/1994 |
| JP | 07314650 | 12/1995 |
| JP | 08336955 | 12/1996 |

* cited by examiner

*Primary Examiner*—Andrew H. Hirshfeld
*Assistant Examiner*—Leo T. Hinze
(74) *Attorney, Agent, or Firm*—Arnold B. Silverman; William F. Lang, IV; Eckert Seamans Cherin & Mellott, LLC

(57) ABSTRACT

A method of preventing an ink from increasing in viscosity is praticed by repeatedly performing the steps of supplying provided from an ink supply-aspiration nozzle to an ink reservoir provided between an inking roll and a squeeze roll pressed into contact with the inking roll, moving the nozzle toward one end of the reservoir and causing the nozzle to aspirate a predetermined amount of ink to produce a flow of ink in the reservoir toward the end thereof, and moving the nozzle toward the other end of the reservoir and similarly causing the nozzle to aspirate a predetermined amount of ink to thereby produce a flow of ink toward the other end. A diluting liquid is supplied to the reservoir while performing these steps.

5 Claims, 9 Drawing Sheets

FIG. 4A ASPIRATION OF INK BY LOWERED NOZZLES 4
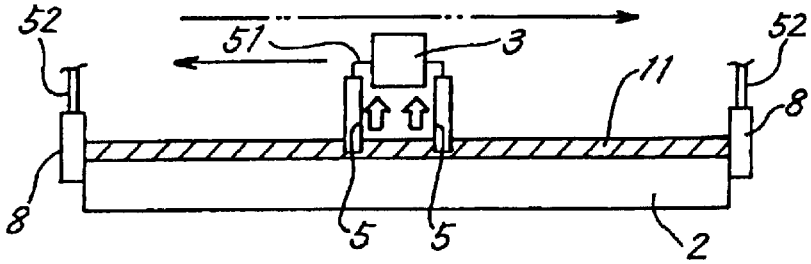
FIG. 4B SUPPLY OF CLEANING WATER BY NOZZLES 34, WITH NOZZLES 4, 5 RAISED
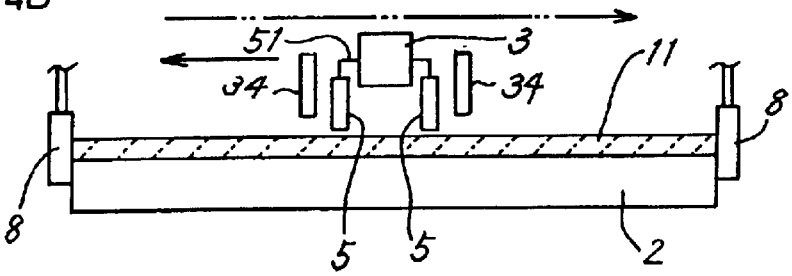
FIG. 4C ASPIRATION OF WASTE AT FOUR LOCATIONS, i. e., BY LOWERED NOZZLES 5 AND VIA WEIRS
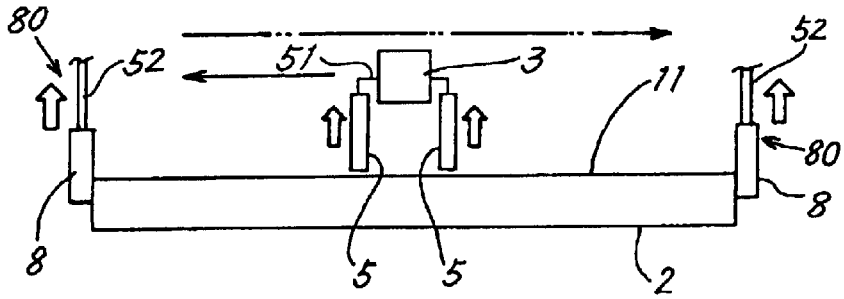

METHOD OF INK AGITATION BY INK ASPIRATION

FIELD OF THE INVENTION

The present invention relates to a method of printing corrugated board sheets, and more particularly to a method of preventing ink for printing presses from increasing in viscosity and a printing press for use in practicing the method.

BACKGROUND OF THE INVENTION

The flexographic printing method wherein an aqueous ink is used for printing corrugated board sheets has the advantage that the ink dries rapidly, permitting the sheet to be fed directly to the subsequent step such as stamping immediately after printing.

FIG. 9 is a side elevation of a conventional flexographic printing press, and FIG. 10 is a fragmentary perspective view of the same (see the specification of JP-A No. 5-200986/1993). An inking roll 1 and a squeeze roll 2 are in contact with each other, and an ink reservoir 11 in the form of a groove is formed between the two rolls 1, 2. Disposed under the inking roll 1 in contact therewith is a plate cylinder 9 provided with a printing plate 90. A support roll 91 is disposed under the plate cylinder 9. The inking roll 1 is movable toward or away from the plate cylinder 9. When the two rolls 1, 2 are rotated in ink squeezing directions (inward directions), the ink on the surface of the inking roll 1 is transferred to the printing plate (not shown) attached to the plate cylinder 9, printing a corrugated board sheet S fed to the nip between the plate cylinder 9 and the support roll 91.

With reference to FIG. 10, the ink is supplied from a container 96 placed on the floor to the ink reservoir 11 via a pump 97, supply pipe 94 and supply nozzle 4. The ink for use in flexographic printing presses readily dries and therefore becomes solidified due to a rise in viscosity unless incessantly held in circulation. Accordingly, the ink flowing out from the ends of the two rolls 1, 2 is received by ink pans 98, 98 and collected in the container 96 through a return pipe 95 for continuously circulating the ink during printing. The return pipe 95 and the supply pipe 94 are over 8 m in length.

The ink invariably partly remains in the return pipe 95 and the supply pipe 94 without being fully collected in the event of a change of ink, for example, for a color change. The remaining portion of ink is washed away and discarded during cleaning. Further because the path of circulation of the ink is long, a large amount of liquid waste is produced by cleaning the path, consequently necessitating great equipment for treating the liquid waste. This entails the problem that the liquid waste treatment requires great initial cost and running cost.

FIG. 8 shows a printing press comprising a closed box 3 which is slidable along an ink reservoir 11 and which has incorporated therein a removable ink tank 31 and is provided with an ink supply nozzle 4 (see U.S. Pat. No. 5,697,299).

An object of the present invention is to provide a printing method wherein a flexographic ink is used and yet which does not require a long circulation path, prevents the ink from increasing in viscosity, diminishes the waste of ink in the event of a change of ink and does not necessitate any great equipment for the treatment of cleaning liquid waste, and more particularly to provide a method of preventing ink from increasing in viscosity and a printing press for use in practicing the method.

SUMMARY OF THE INVENTION

The present invention provides a method of printing by a printing press wherein an ink is supplied from an ink supply-aspiration nozzle 4 to an ink reservoir 11 provided between an inking roll 1 and a squeeze roll 2 pressed into contact with the inking roll 1, and the ink is transferred from the inking roll 1 to a printing plate attached to a plate cylinder 9 by the rotation of the inking roll 1, the ink supply-aspiration nozzle 4 being connected to a closed box 3 housing an ink tank 31 therein, the closed box 3 and the ink supply-aspiration nozzle 4 being movable along the ink reservoir 11. The printing method is practiced by repeatedly performing the steps of:

supplying the ink from the supply-aspiration nozzle 4 to the ink reservoir 11 at a location above the ink reservoir 11, i.e., at a midportion thereof, moving the supply-aspiration nozzle 4 from the location along the ink reservoir 11, thereafter halting the nozzle 4 and causing the nozzle 4 to aspirate a predetermined amount of ink from the ink reservoir 11 to place the aspirated ink into the ink tank 31 within the closed box 3 and produce a flow of ink in the ink reservoir 11, further moving the supply-aspiration nozzle 4 from the halted location along the ink reservoir 11 and causing the nozzle 4 to aspirate a predetermined amount of ink from the reservoir 11 to place the aspirated ink into the ink tank in the closed box 3 and produce a flow of ink in the ink reservoir 11.

A diluting liquid is supplied to the ink reservoir 11 while performing the above steps.

After supplying the ink, the supply-aspiration nozzle 4 is moved first toward one end of the ink reservoir 11, and subsequently toward the other end of the reservoir 11.

When the nozzle 4 aspirates the ink from one end portion of the ink reservoir 11 and places the ink into the ink tank 31 within the closed box 3, the liquid level of the ink lowers at the end portion, permitting the ink to flow toward the end portion. Since like step is also performed at the other end portion of the reservoir 11, the ink similarly moves along the reservoir 11 toward the other end portion. Ink is then supplied to the reservoir at a location away from the two end portions. A flow of ink also occurs at this time.

Since the above cycle is repeated during the printing operation, the ink incessantly flows in the ink reservoir 11, which is continuously stirred, whereby the ink is prevented from increasing in viscosity. Especially because the ink flows between the opposite end portions of the ink reservoir 11, the ink moves over an increased distance and is stirred effectively. The diluting liquid supplied for replenishment is thoroughly mixed with the ink owing to the stirring effect produced by the flow of ink.

The ink supply-aspiration nozzle 4 is slidable with the closed box 3 removably housing the ink tank 31 therein, so that the pipe channel between the nozzle 4 and the closed box 3 can be shortened. This prevents the ink from increasing in viscosity without necessitating a long circulation path conventionally required, consequently greatly diminishing the waste of ink to be involved in changing the ink and permitting liquid waste treatment at a much lower cost than conventionally.

BRIEF DESCRIPTION OF THE DRAWINGS

FIG. 4A to FIG. 4C are diagrams for illustrating the movement of liquid waste collecting nozzles for collecting a cleaning liquid waste;

DESCRIPTION OF THE PREFERRED EMBODIMENTS (Overall Construction)

Figure 1:
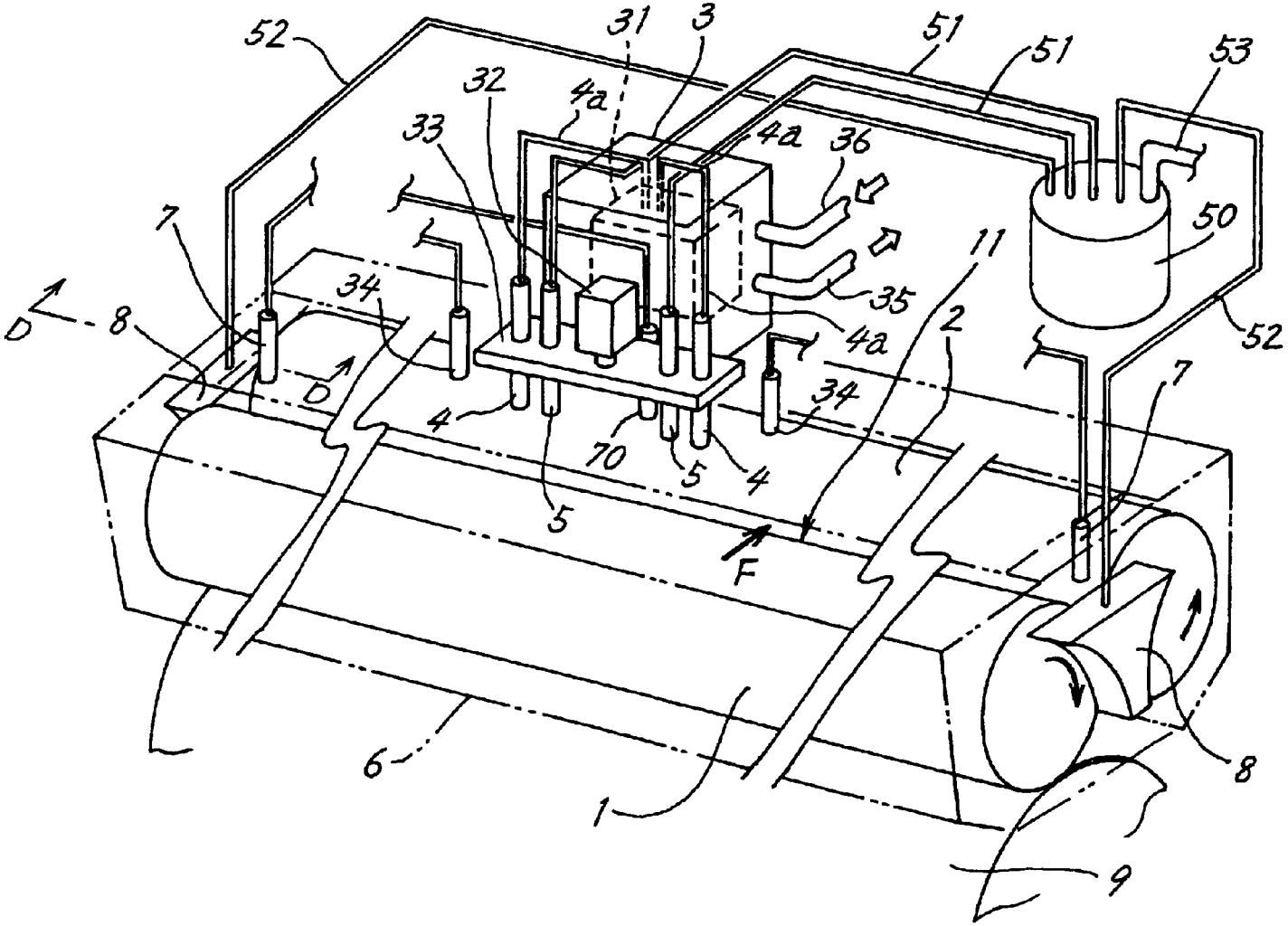
FIG. 1 is a perspective view showing an inking roll, a squeeze roll and ink supply-aspiration nozzles of a corrugated board printing press.

FIG. 1 is a perspective view showing an inking roll 1 and a squeeze roll 2 of a corrugated board printing press. The present embodiment is characterized by prevention of an increase in the viscosity of ink in an ink reservoir 11.

As in the prior art, the inking roll 1 and the squeeze roll 2 are arranged so as to be movable toward or away from each other, and the ink reservoir 11 in the form of a groove is provided between the two rolls 1, 2.

Ink is supplied to the ink reservoir 11 from ink supply-aspiration nozzles 4 tone described later, and the surface of the liquid is maintained at a predetermined level by a liquid level sensor (not shown).

The two rolls 1, 2 are rotatable in directions (inward directions) to squeeze the ink of the reservoir 11, and the ink on the surface of the inking roll 1 is transferred to a printing plate on a plate cylinder 9 to print a corrugated board sheet.

The inking roll 1 is a ceramic roll, plated roll or like hard roll provided with fine indentations or projections over the surface thereof, while the squeeze roll 2 has a surface provided by rubber. The rolls 1 and 2 are 1.5 to 4.7 m in axial length although the length differs with the type of printing press. The rolls 1, 2 are provided at opposite ends thereof with weir members 8, 8 for closing the respective ends of the ink reservoir 11. As will be described later, the ink is collected also through the weir members 8, 8. A cover 6 is provided around the rolls 1, 2 and the weir members 8, 8.

Cover

Figure 2:
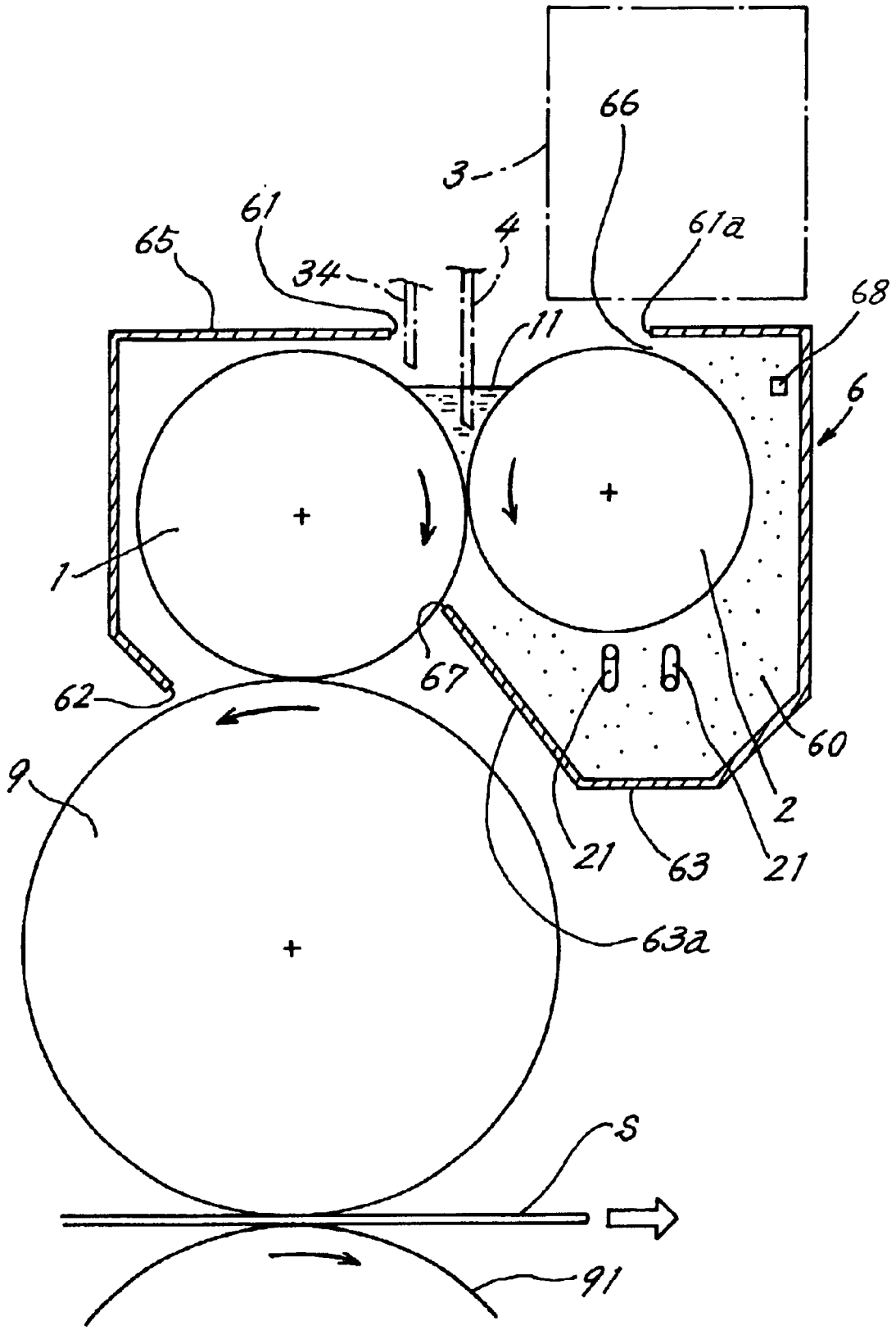
FIG. 2 is a right side elevation of FIG. 1.

FIG. 2 is a right side elevation of FIG. 1 and shows the cover 6 as partly broken away. As shown in FIGS. 1 and 2, the cover 6 is in the form of a case housing the two rolls 1, 2 therein. The cover 6 includes a top plate 65 which has an opening 61 for fitting therein the nozzles 4, 5, 34, 70 to be described below and movable along the ink reservoir 11, the opening 61 being formed at a position above and opposed to the ink reservoir 11. The cover 6 has a lower side provided with an opening 62 for permitting the printing plate (not shown) on the plate cylinder 9 to come into contact with the inking roller 1.

The cover 6 has a bottom plate 63 opposed to the squeeze roll 2 and bent obliquely upward toward the inking roll 1. The upper edge of the bent portion serves as a closing plate 63*a* positioned in proximity to the inking roll 1 with a clearance 67 formed therebetween.

The upper opening 61 of the cover 6 has an opening edge 61*a* positioned above and close to the squeeze roll 2 with a clearance 66 formed therebetween.

Accordingly, the interior of the cover 6 provides a mist chamber 60 around the squeeze roll 2, with the small clearances 66 and 67 formed between the cover and the respective rolls 2, 1.

The mist chamber 60 is internally provided with one or a plurality of fine spray nozzles 21. The fine spray nozzles 21 force out a diluting liquid in the form of a fine mist to maintain the mist chamber 60 at a high humidity close to a saturated state to positively wet the surface of the squeeze roll 2 by depositing thereon fine particles of diluting liquid in the form of a thin film. The fine mist is up to 50 $\mu$m in particle size, preferably up to 30 $\mu$m in particle size to ensure ease of application.

With the illustrated embodiment, a pair of fine spray nozzles 21, 21 are arranged below the central portion of the squeeze roll 2, as spaced apart by a small distance along the length of the roll and directed obliquely upward. The nozzles are arranged with their forward ends oriented toward each other (see FIG. 3A).

The mist chamber 60 is internally provided with a humidity sensor 68 for controlling the spraying and cessation of spraying. The mist chamber 60 is maintained at a high humidity close to a saturated state.

Closed Box and Ink Supply-Aspiration Nozzles

A closed box 3 is disposed above the squeeze roll 2 with the cover top plate 65 positioned therebetween. The closed box 3 is slidable in parallel to the squeeze roll 2.

As will be described below, the closed box 3 is a component which is important for supplying and collecting the ink, and also serves to support the ink supply-aspiration nozzles 4 and cleaning liquid waste collecting nozzles 5. The box 3 is coupled to a slide drive device 25 and slidable along the ink reservoir 11.

With reference to FIG. 1, the closed box 3 removably houses therein an ink tank 31 and is externally provided with a nozzle mount plate 33 coupled to a lift drive unit 32 such as a cylinder device and movable upward and downward.

The nozzle mount plate 33 is positioned horizontally above the ink reservoir 11 and has two ink supply-aspiration nozzles 4, 4 respectively at opposite ends thereof and two cleaning liquid waste collecting nozzles 5, 5 positioned inwardly of the respective nozzles 4, 4. The nozzles 4, 5 are directed downward.

To be suitable, the distance between the two ink supply-aspiration nozzles 4, 4 is 20 to 60 cm, for example, in accordance with the size of the printing press and the size of the closed box 3.

The nozzles 4, 5 have sharp lower ends cut obliquely in conformity with the bottom shape of the ink reservoir 11. The nozzles 4, 5 have their lower ends positioned at the same level.

Figure 7A:
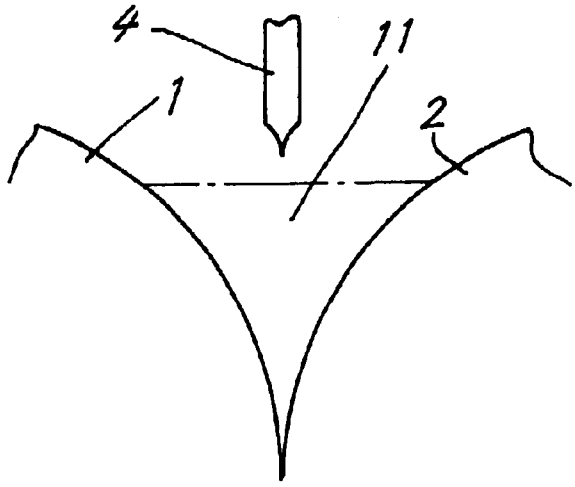
FIGS. 7A, 7B and 7C are side elevations showing a raised position of the ink supply-aspiration nozzle, an intermediate position thereof and a lowered position thereof, respectively.
Figure 7B:
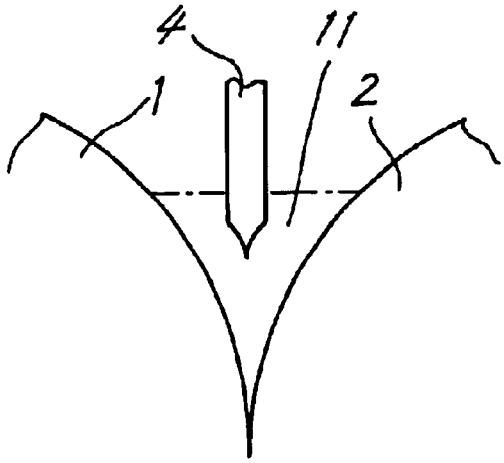
Figure 7C:
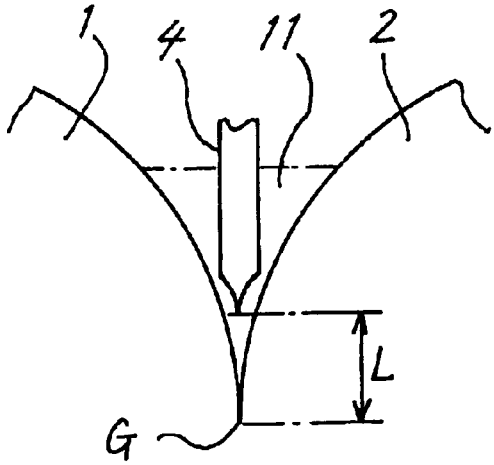

The nozzle mount plate 33 is movable upward and downward between a raised position and a lowered position by the lift drive unit 32. When in the raised position, the nozzles 4, 5 have their lower ends positioned at a level slightly higher than a predetermined ink level of the ink reservoir 11 (see FIG. 7A) When the nozzles 4, 5 are at an intermediate position, the lower ends are immersed in the ink reservoir 11 (see FIG. 7B). When in the lowered position, the nozzles 4, 5 have their lower ends positioned at the deepest portion of the ink reservoir 11, such that the nozzle ends are barely held out of wedging contact with the rolls 1, 2 (see FIG. 7C). Stated more specifically, the distance between the point of contact, G, between the two rolls and the lower ends of the nozzles 4, 5 in the lowered position is several millimeters.

Each of the ink supply-aspiration nozzles 4 has connected thereto one end of a flexible pipe 4*a* removably and hermetically extending into the closed box 3 and having the other end immersed in the ink tank 31. The length from the forward end of the nozzle 4 to the immersed end of the pipe 4*a* in the ink tank 31 can be as short as about 1.2 m.

Connected to the closed box 3 are a vacuum suction pipe 35 and a pressurized air supply pipe 36. By sending pressurized air into the closed box 3 from the supply pipe 36, ink can be forced out from the ink tank 31 and supplied from the ink supply-aspiration nozzles 4 to the ink reservoir 11.

By aspirating air from the closed box 3 through the vacuum suction pipe 35 and reducing the internal pressure of the closed box 3, suction is caused to act on the nozzles 4 to aspirate ink from the ink reservoir 11 and place the ink into the ink tank 31.

Although the vacuum suction pipe 35 and the pressurized air supply pipe 36 are individually connected to the closed box 3 as seen in FIG. 1, a common pipe is alternatively usable for aspiration and pressure application.

Each of the liquid waste collecting nozzles 5 is connected to a suction pipe 51, which is a flexible pipe, and then to a collecting can 50. Connected to the can 50 is a vacuum suction pipe 53, through which air is aspirated from the can 50 to reduce the internal pressure of the can 50. Also connected to the collecting can 50 are suction pipes 52 which are connected to the respective weir members 8.

Figure 5A:
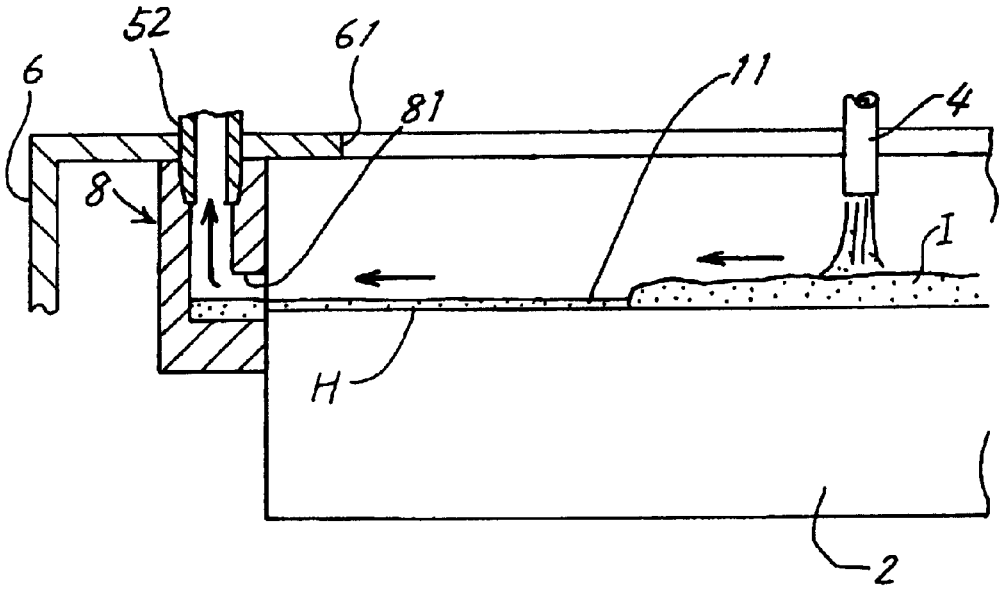
FIG. 5A and FIG. 5B are views showing a weir member in section along a vertical plane containing the line D—D in FIG. 1.
Figure 5B:
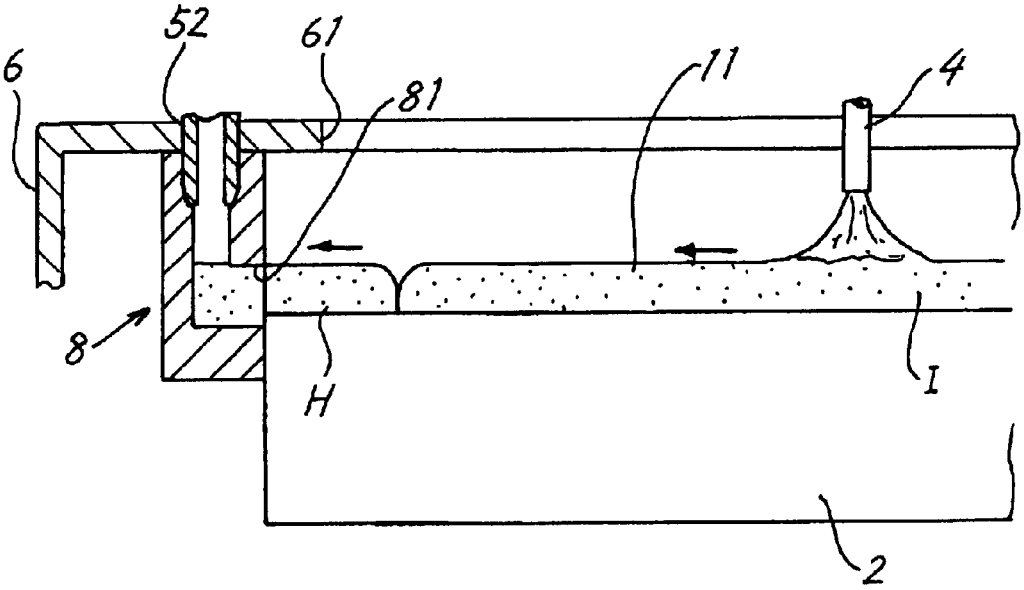

FIGS. 5A and 5B are views showing the weir member 8 in section along a vertical plane containing the line D—D in FIG. 1. The weir member 8 has a discharge channel 81 extending from a side wall thereof damming the ink reservoir 11 to the upper face thereof and communicating with the collecting can 50 through the suction pipe 52. When the can 50 is reduced in internal pressure, a liquid waste produced by cleaning the reservoir 11 can be aspirated via the suction pipes 51 and the liquid waste collecting nozzles 5. The liquid waste can be aspirated also through the discharge channels 81 of the weir members 8 and via the suction pipes 52.

The closed box 3 is provided with two cleaning liquid supply nozzles 34, 34 and a diluting liquid supply nozzle 70, in addition to the nozzles 4, 5 described.

The cleaning liquid supply nozzles 34, 34 are positioned above the inking roll 1 and connected to a cleaning liquid supply device (not shown) for applying dropwise or by spraying a specified amount of cleaning liquid to the rolls 1, 2 for cleaning.

Arranged at opposite ends of the ink reservoir 11 are diluting liquid supply nozzles 7, 7 which are so positioned as to avoid collision with the closed box 3.

The diluting liquid supply nozzles 7, 7, 70 are connected to a diluting liquid supply device (not shown), which applies a diluting liquid dropwise to the ink reservoir 11 in accordance with the rate at which the ink is used and with the rate of supply of the ink so as not to dilute the ink in the reservoir 11 to excess.

The cleaning liquid, the diluting liquid, and the diluting liquid to be sprayed from the fine spray nozzles 21, 21 are tap water according to the present embodiment. Additives may be added to the water, or a liquid suitable for the characteristics of the ink may be used.

Figure 8:
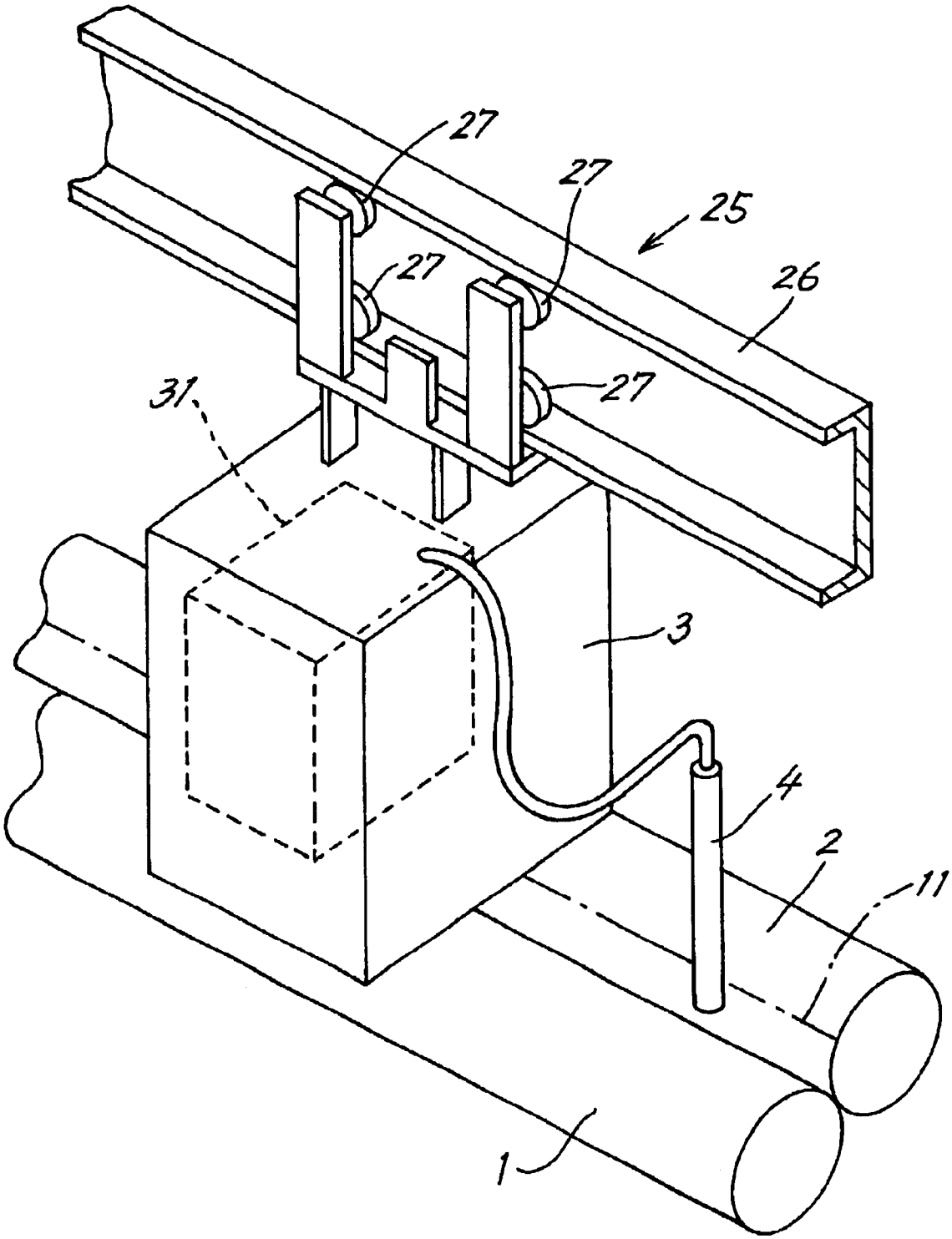
FIG.8 PRIOR ART
FIG. 8 is a perspective view of a conventional printing press wherein flexographic ink is not used.
Figure 9:
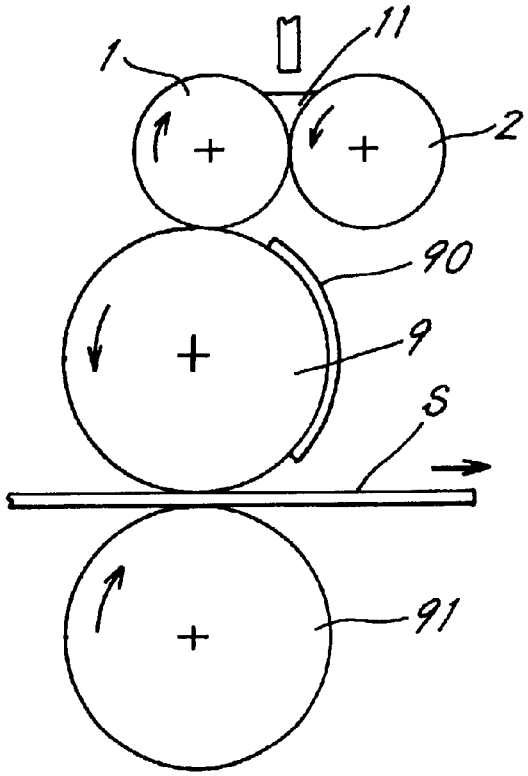
FIG. 9 PRIOR ART
FIG. 9 is a side elevation of a conventional flexographic printing press.
Figure 10:
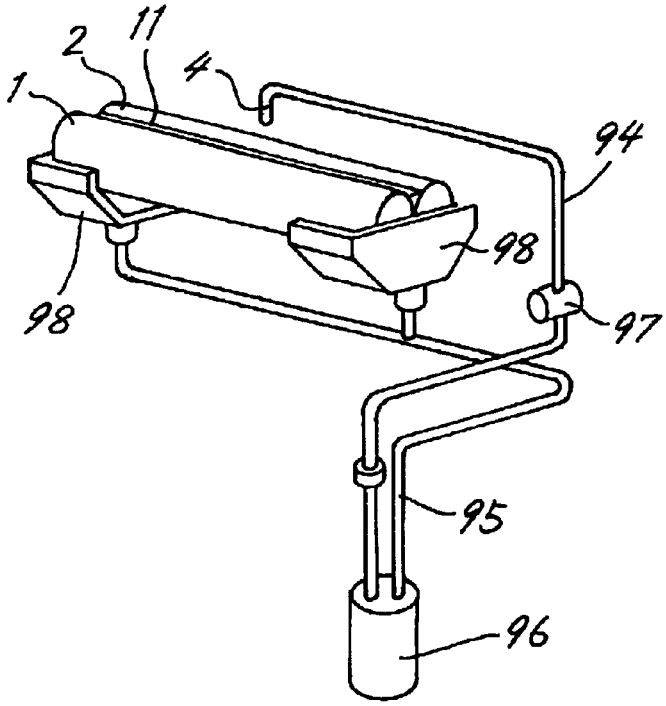
FIG. 10 PRIOR ART
FIG. 10 is a fragmentary perspective view of the flexographic printing press of FIG. 9.

The slide drive device 25 slidingly moves the closed box 3 along the ink reservoir 11. FIG. 8 shows an example of such device which appears useful. The illustrated device comprises a rail 26 extending along the ink reservoir 11 and positioned above the rolls 1, 2, and rollers 27, 27, 27, 27 connected to the closed box 3 and fitted in the rail 26. The closed box 3 runs along the rail 26. As previously stated, the lift drive unit 32 attached to the closed box 3 moves the nozzle mount plate 33 upward and downward (see FIG. 1).

The slide drive device 25 can be selectively set in one of at least two modes, i.e., an ink collection-cleaning liquid collection mode and an ink circulation mode, as will be described below. The ink collection-cleaning liquid collection mode for a color change is such that the closed box 3 is reciprocatingly traveled over the entire length of the ink reservoir 11 once or a plurality of times to collect the ink and cleaning liquid. This operation is shown in FIG. 4A to FIG. 4C. The ink circulation mode is involved in the printing operation, and the operation in this mode is shown in FIG. 3A to FIG. 3D.

The operations of the printing press in the ink circulation mode and in the ink collection-cleaning liquid collection mode will be described below.

(Supply of Ink in Ink Circulation Mode)

FIG. 3A to FIG. 3D are diagrams for illustrating the movement of the ink supply-aspiration nozzles 4 in the ink circulation mode. The nozzles 4 are shown as seen from the upstream side of the printing machine of FIG. 1 with respect to the direction of supply of paper, i.e., from the direction of arrow F. For the sake of convenience of illustration, the cover 6 and the liquid waste collecting nozzles 5 are not shown.

Ink is supplied to the ink reservoir 11 in an empty state from the ink supply-aspiration nozzles 4 provided on the closed box 3 while slidingly moving the closed box 3 along the ink reservoir 11. At this time, the inking roll 1 and the squeeze roll 2 are held in rotation to prevent a boundary line of ink level from adhering to the rolls 1, 2 and to stir the ink.

Figure 3A:
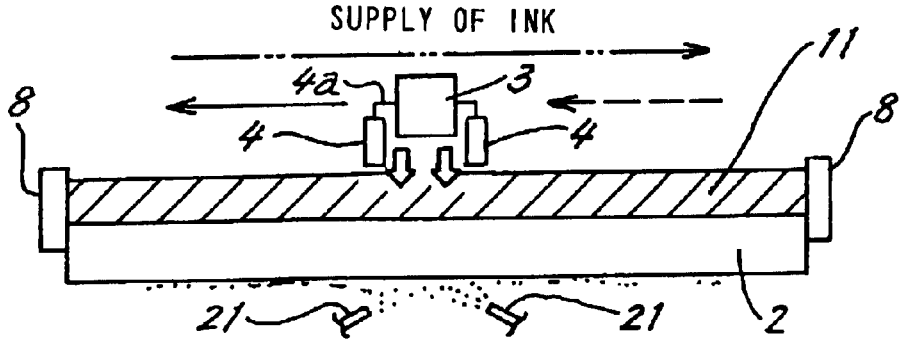
FIG. 3A to FIG. 3D are diagrams for illustrating the movement of the ink supply-aspiration nozzles for supplying ink and in an ink circulation mode.

When the ink is supplied to a predetermined ink level, the liquid level sensor functions to discontinue the supply of ink, and the closed box 3 is once returned to the midportion of the ink reservoir 11 (FIG. 3A). At this time, the nozzles 4 are held immersed in the ink reservoir 11, with about 2 liters of ink supplied thereto. The two rolls 1, 2 are thereafter held in rotation to start a printing operation.

During the supply of ink and printing operation, the squeeze roll 2 is covered with fine particles of diluting liquid over the surface thereof and positively wetted and the mist chamber 60 is filled with a fine mist, by applying the diluting liquid to the roll from the fine spray nozzles 21, 21.

The mist chamber 60 is held at a high humidity as nearly saturated with the fine mist. Accordingly, fine particles of diluting liquid for covering the surface of the squeeze roll 2 are continuously carried to the ink reservoir 11 by the rotation of the roll.

If water or like ink diluting liquid is applied dropwise to the ink reservoir 11 directly, the diluting liquid will not become compatible and miscible with the ink immediately due to differences between the diluting liquid and the ink in characteristics (specific gravity, viscosity, etc.). According to the present embodiment, however, the peripheral surface of the squeeze roll 2 is wetted with fine particles of diluting liquid, and the wetting particles are brought into the ink reservoir 11 by the rotation of the roll 2. Consequently, the liquid over the surface of the roll 2 becomes immediately compatible with the ink in the reservoir 11 to mix therewith smoothly, producing no irregularities in the viscosity of the ink.

The squeeze roll 2 can be effectively wetted over the surface by arranging the fine spray nozzles 21, 21 below the roll 2, each as directed toward the remote roll end according to the present embodiment. Thus, the squeeze roll 2 can be wetted over a wide range with a fine mist since the fine spray nozzles 21, 21 are adapted to apply the fine mist over an increased distance.

Furthermore, the fine mist leaking from the narrow outlet 66 of the mist chamber 60 above the squeeze roll 2 produces a highly humid atmosphere around the ink reservoir 11, so that the evaporation of water from the ink reservoir 11 is suppressed to prevent the ink from increasing in viscosity.

Incidentally, JP-A No. 6-947/1994 discloses a fine mist filling up the interior of the cover 6 enclosing the squeeze roll 2 therein. According to the present embodiment, however, the fine spray nozzles 21, 21 are arranged below the squeeze roll 2, permitting fine particles of diluting liquid for covering the roll surface to be carried to the ink reservoir 11 by the rotation of the squeeze roll 2. This makes it possible to effectively dilute the ink even if the squeeze roll 2 is positioned close to the top plate 65 of the cover 6.

(Circulation of the Ink)

When the ink circulation program is set by the user manipulating the control panel (not shown) of the printing press, the ink supply-aspiration nozzles 4 as brought to the raised position at the location shown in FIG. 3A by the lift drive unit 32 supply the ink for about 6 seconds from the ink tank 31 in the closed box 3. During the printing operation, the ink circulation program may be set at all times.

Figure 3B:
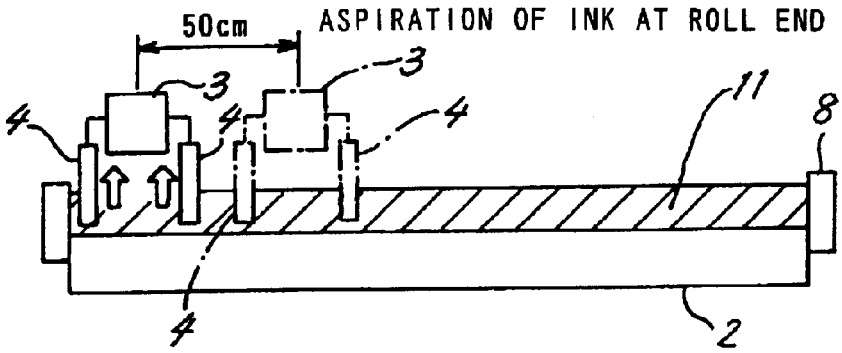

The closed box 3 thereafter moves to one end of the ink reservoir 11 as seen in FIG. 3B. The nozzles 4 as brought to this location are lowered to the intermediate position and immersed into the ink in the reservoir 11 (as indicated in solid lines in FIG. 3B). After collecting the ink into the closed box 3 for about 2 seconds, the nozzles 4 aspirate the ink from the reservoir 11 while moving from this location toward the mid portion of the reservoir 11 over a predetermined section, i.e. about 50 cm according to the embodiment (the position indicated in chain lines in FIG. 3B). This section will be termed a first collecting section.

When the nozzles 4 aspirate the ink in the first collecting section of the ink reservoir 11, the liquid level in this section lowers, producing a flow of ink from the mid portion of the reservoir 11 to the first collecting section.

Moving the nozzles 4 in the first collecting section produces an effect to stir the ink.

Figure 3C:
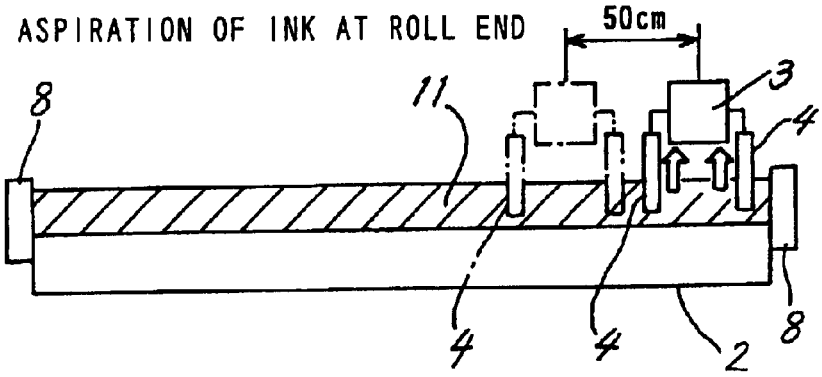
Figure 3D:
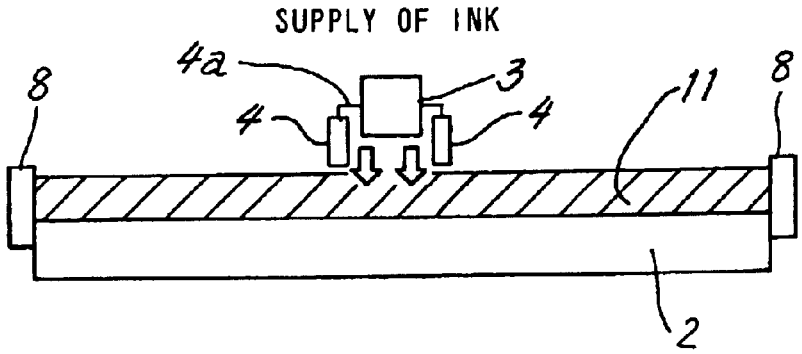

Next, the lower ends of the nozzles 4 are withdrawn from the ink with the aspiration of ink discontinued, and the closed box 3 is moved toward the opposite end of the ink reservoir 11, where the nozzles 4 are lowered into the ink (the position indicated in solid lines in FIG. 3C). As performed in the first collecting section, the ink is collected into the closed box 3 for about 2 seconds, and the ink is thereafter aspirated while moving the closed box 3 and the nozzles 4 toward the midportion of the reservoir 11 over like section (the position indicated in chain lines in FIG. 3C). As in the foregoing case, the liquid level of the collecting section (termed a second collecting section) lowers, producing a flow of ink in the reservoir 11, i.e., from the mid portion of the reservoir 11 toward the second collecting section.

Subsequently, the lower ends of the nozzles 4 are withdrawn from the ink with the aspiration of ink discontinued, and the closed box 3 is moved to a position away from the position of aspiration, that is, returned to the midportion of the reservoir 11 according to the embodiment. At this position, ink is supplied to the reservoir 11 from the nozzles 4 as held in the raised position. The liquid level sensor functions to control the liquid level as predetermined.

The cycle described above is repeated during the printing operation for the circulation of ink between the ink reservoir 11 and the ink tank 31.

On completion of the ink circulation mode, the closed box 3 remains at the midportion of the ink reservoir 11 for waiting.

During the printing operation, suitable amounts of diluting liquid are supplied from the supply nozzles 7, 7 at opposite ends of the reservoir 11 and the supply nozzle 70 on the closed box 3.

Thus during the printing operation, the nozzles 4 repeatedly aspirate the ink toward the opposite ends of the reservoir 11 and supply the ink at the midportion of the reservoir 11, whereby flows of ink are incessantly produced in the ink reservoir 11 to stir the ink. Especially because the ink flows between opposite ends of the reservoir 11, the distance of movement of the ink is great to effectively stir the ink.

The ink supply-aspiration nozzles 4 move with the closed box 3 for containing the ink. This shortens the paths of flow of the ink, obviating the need for a long circulation path conventionally required and preventing the ink from increasing in viscosity.

If the lower ends of the nozzles 4 are positioned adequately away from the bottom end of the ink reservoir 11, the nozzles 4 may be moved as immersed in the reservoir 11.

The ink has a lower viscosity at the locations where the diluting liquid is supplied by the nozzles 7, 7, 70. However, the ink can be prevented from increasing in viscosity and from producing irregularities in viscosity by the flows of ink produced by the aspiration of ink by the nozzles 4 in the two collecting sections and by the flows of ink produced by replenishing the ink to compensate for the consumption by printing.

Especially according to the embodiment, the ink is collected into the ink tank 31 by the nozzles 4 at the locations where the ink is temporarily reduced in viscosity owing to the supply of diluting liquid from the nozzles 7, 7. This produces an effect to adjust the viscosity of ink within the ink tank 31.

(Ink Collection-Cleaning Liquid Waste Collection Mode)

After a predetermined quantity of prints have been produced, there arises a need to change the ink for a color change in preparation for the subsequent printing operation. At this time, the ink adhering to the rolls 1, 2 are cleaned.

FIG. 4A to FIG. 4C are diagrams for illustrating the movement of liquid waste collecting nozzles 5 in the ink collection-cleaning liquid waste collection mode.

For a change of ink, the rolls 1, 2 are brought out of rotation, and the nozzles 4 and collecting nozzles 5 are moved down to the lowered position in the ink reservoir 11 by the lift drive unit 32 (FIG. 4A). The suction pipes 51 connected to the nozzles 5 are flexible and will not interfere with the descent of the nozzles 5.

While slidingly moving the closed box 3, the ink is aspirated from the reservoir 11 by the nozzles 4 provided on the box 3. At this time, the liquid waste collecting nozzles 5 are not used for aspiration.

If a vacuum system is used for aspirating the ink as in the present embodiment, almost all amount of ink can be aspirated from the reservoir 11 by reciprocatingly moving the nozzles 4 over the entire length of the reservoir 11 once or twice.

Subsequently, with the nozzles 4, 5 raised and with the rolls 1, 2 held in rotation, about 100 cc of water serving as a cleaning liquid is sprayed onto the inking roll 1 from the cleaning liquid supply nozzles 34 while sliding moving the closed box 3 (FIG. 4B).

The ink adhering in the form of a thin film to the inking roll 1 is almost completely washed away, and the resulting cleaning liquid waste collects in the ink reservoir 11.

Because the ink adhering to the roll 1 in the form of a thin film is in a very small amount and further because the ink is aqueous, the quantity of liquid needed for cleaning can be very small.

The rolls 1, 2 are stopped, and the nozzles 4, 5 are brought to the lowered position in the reservoir 11. The liquid waste is aspirated into the collecting can 50 by the liquid waste collecting nozzles 5 only, with no suction acting on the nozzles 4, while slidingly moving the closed box 3.

The suction acting on the collecting can 50 also acts on the discharge channels 81 in the weir members 8 at opposite ends of the ink reservoir 11 at the same time, collecting the cleaning liquid waste also through the weir members 8 into the can 50 (FIG. 4C). As in collecting the ink, almost all amount of liquid waste can be aspirated from the reservoir 11 by reciprocatingly moving the nozzles 5 over the entire length of the reservoir 11 once or twice. After the collection of the liquid waste, the closed box 3 remains at the lengthwise midportion of the reservoir 11 for waiting.

Thus, the ink can be collected almost without any loss for a change of ink, the quantity of cleaning water required for cleaning the roll can be small therefore, and the resulting liquid waste has a low concentration. Accordingly, there is no need to use great equipment for the treatment of cleaning liquid waste, and the waste can be treated at a reduced running cost.

For the color change, the ink tank 31 within the closed box 3 is replaced.

Next, the nozzles 4, 5 are raised, a new ink is supplied from the ink supply-aspiration nozzles 4 with the rolls 1, 2 held in rotation.

In this case, the nozzles 4 remain in the standby position instead of being moved laterally. Suction is caused to act on the collecting can 50.

As shown in FIG. 5A, the ink I flowing out of each nozzle 4 flows along the bottom of the ink reservoir 11 toward the weir member 8. A small amount of cleaning liquid waste H remaining uncollected is left on the bottom of the reservoir 11. However, the flow of ink I toward the weir member 8 forces out the remaining waste H.

The liquid waste H is forced toward the weir member 8 almost without mixing with the ink I owing to the force of the flow of ink I and the differences between the liquid waste and the ink in properties such as specific gravity and viscosity.

The liquid level rises while the ink I and waste H are approaching the weir member 8 as shown in FIG. 5B.

With the suction of the collecting can 50 acting on the discharge channel 81 in the weir member 8, the liquid waste forced out into the discharge channel 81 is aspirated into the can 50.

With the liquid waste forced toward the weir member 8 as described above, the liquid level of the waste gradually rises to close the opening of the discharge channel 81 on the reservoir side with the liquid waste. This reduces the leak of air through the discharge channel 81, permitting the suction to act effectively for the aspiration of the waste.

Immediately before the ink is admitted into the can 50 for collection through the discharge channel 81, the aspiration by the can 50 is discontinued. This can be realized, for example, by measuring in advance the time taken for the ink supplied to the midportion of the reservoir 11 to reach the end of the reservoir 11 and setting the time value on a timer, or by providing a liquid quality sensor for detecting the difference between the liquid waste and the ink in the quality of liquid at the end of the ink reservoir 11. In actuality, the collection of liquid waste continues for about 40 seconds.

As stated above, almost all the amount of liquid waste can be collected. Since the portion of waste remaining to wet the wall surface of the ink reservoir 11 or remaining uncollected is in a very small amount, the ink will not be affected if the waste becomes mixed with the ink.

According to the present embodiment, two ink supply-aspiration nozzles 4, 4 provided are moved through the two sections as immersed in the ink. Alternatively it appears feasible to arrange an increased number of nozzles 4 along the length of the ink reservoir 11 and to cause the nozzles 4 to aspirate the ink without moving the nozzles. In this case, however, the ink will not be stirred effectively.

According to the present embodiment, the ink is supplied at the midportion of the ink reservoir 11 and aspirated at the end portions thereof. Alternatively, the ink may be supplied at the end portions of the reservoir 11 and aspirated at the midportion thereof.

Although the squeeze roll 2 is used as a member for squeezing the ink on the inking roll 1 according to the foregoing embodiment, the squeezing member is not limited to such a roll. For example as shown in FIG. 6, a striplike plate 22 can be held in pressing contact with the inking roll 1 over the entire length of the roll 1 to provide an ink reservoir 11 between the roll 1 and the plate 22.

Figure 6:
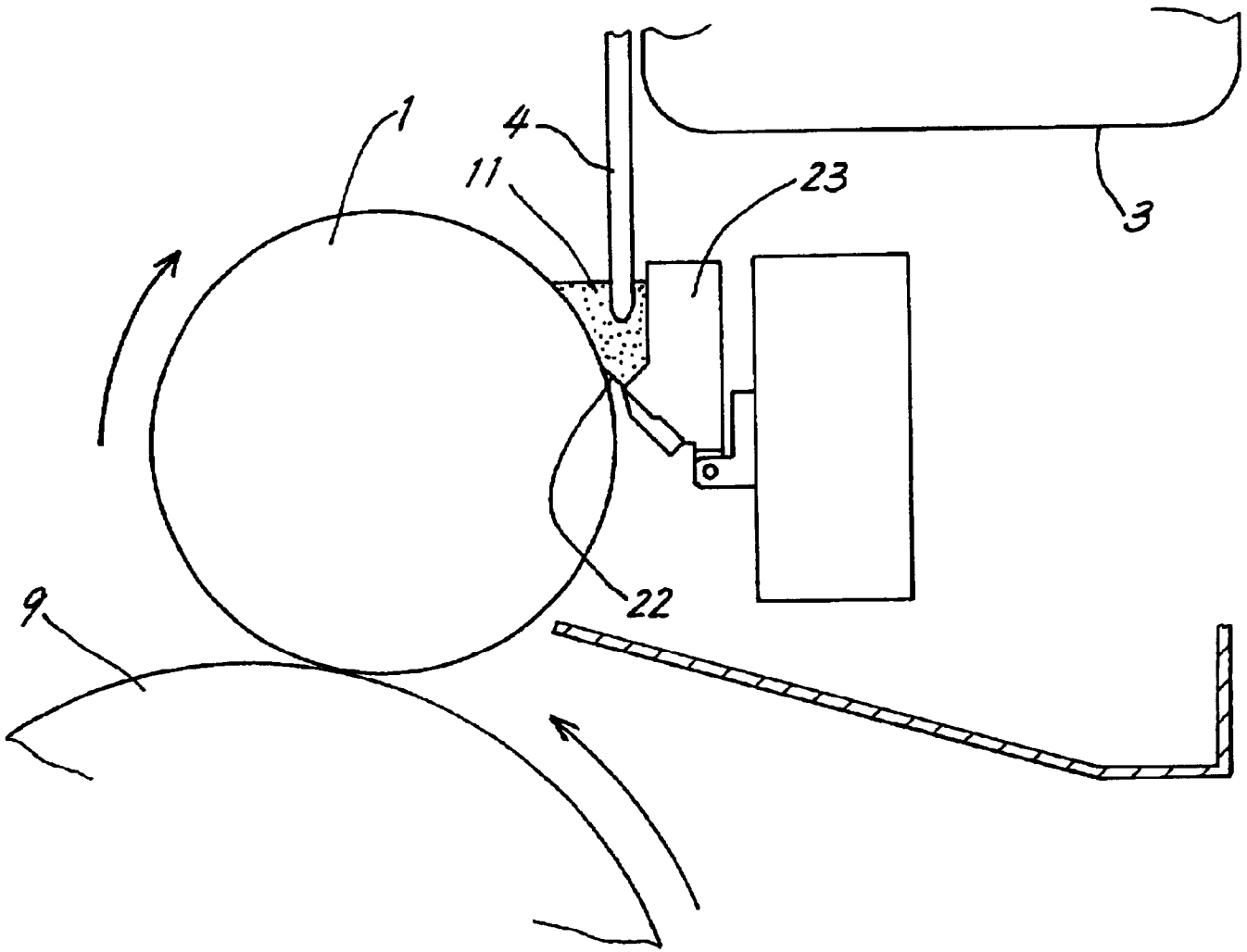
FIG. 6 is a view in section showing another embodiment of squeeze member for the inking roll.

The striplike plate 22 shown in FIG. 6 is directed as opposed to the direction of rotation of the inking roll 1, and a block 23 supporting the plate 22 provides a wall for the ink reservoir. 11, with the plate 22 serving also as the bottom portion of the reservoir 11.

According to the foregoing embodiment, the ink is supplied to and collected from the reservoir 11 by giving an increased pressure and a reduced pressure, respectively, to the interior of the closed box 3, while the cleaning liquid waste is collected by giving a reduced pressure to the collecting can 50. However, tubing pumps may be used for supplying and collecting the ink and for collecting the liquid waste.

When the remaining liquid waste H is forced out toward the end of the ink reservoir 11 by the ink I supplied to the reservoir 11, the waste is collected through the discharge channel 81 in the weir member 8 and via the suction pipe 52 in the embodiment described above as shown in FIGS. 5A and 5B. This mode of collection is nevertheless not limitative, but the waste liquid can be allowed to flow down from the end of the reservoir 11 for collection after moving the weir member 8 away from the end faces of the rolls 1, 2.

The present invention is applicable not only to aqueous inks but can also be practiced for glycol-type inks which are low in viscosity and dry at a satisfactory rate.

What is claimed is:

1. A method of printing by a printing press comprising an ink is supplied from an ink supply-aspiration nozzle to an ink reservoir provided between an inking roll and a squeeze roll pressed into contact with the inking roll, and the ink is transferred from the inking roll to a printing plate attached to a plate cylinder by the rotation of the inking roll, the ink supply-aspiration nozzle being connected to a closed box for collecting therein the ink as aspirated, the closed box and the ink supply-aspiration nozzle being movable along the ink reservoir, the printing method being characterized by repeatedly performing the steps of:

supplying the ink from the supply-aspiration nozzle to the ink reservoir at a first location above the ink reservoir, moving the supply-aspiration nozzle from the first location along the ink reservoir to a second location along the ink reservoir, thereafter halting the nozzle, lowering the nozzle into the ink reservoir, and causing the nozzle to aspirate a predetermined amount of ink from the ink reservoir to place the aspirated ink into the closed box and produce a flow of ink in the ink reservoir, further moving the supply-aspiration nozzle from the second location along the ink reservoir to a third location along the ink reservoir, and causing the nozzle to aspirate a predetermined amount of ink from the reservoir to place the aspirated ink into the closed box and produce a flow of ink in the ink reservoir; and repeating the steps with sufficient frequency to resist an undesirable increase in the viscosity of the ink.

2. A printing method according to claim 1 wherein the location where the ink is supplied to the ink reservoir is a lengthwise midportion of the ink reservoir, the location to which the supply-aspiration nozzle is moved after supplying the ink being toward one end of the ink reservoir, the location to which the supply-aspiration nozzle is subsequently moved being toward the other end of the ink reservoir, said steps being repeatedly performed, and a diluting liquid is supplied to the ink reservoir while performing said steps.

3. A printing method according to claim 2 wherein the supply-aspiration nozzle collects the ink while moving from an end portion of the ink reservoir towards midportion of the ink reservoir over a predetermined section.

4. A printing method according to claim 1 wherein the squeeze roll is cover with a cover, the cover being internally filled with a diluting liquid spray in the form of a fine mist, and the diluting liquid is supplied to the ink reservoir by wetting a surface of the squeeze roll with fine particles of the diluting liquid.

5. A printing method according to claim 1, further comprising spraying an ink diluting liquid in the form of a fine mist onto the squeeze roll, and rotating the squeeze roll, thereby transporting the diluting liquid to the ink reservoir.

* * * * *

UNITED STATES PATENT AND TRADEMARK OFFICE

CERTIFICATE OF CORRECTION

PATENT NO. : 6,739,256 B1
DATED : May 25, 2004
INVENTOR(S) : Ichiro Murakawa et al.

It is certified that error appears in the above-identified patent and that said Letters Patent is hereby corrected as shown below:

Title page,
Item [57], ABSTRACT,
Line 3, delete "provided from", after "an ink" insert, -- from an ink --.

Column 3,
Line 34, delete "tone" and insert -- to be --.

Column 12,
Line 9, after "towards" insert -- the --.
Line 12, "cover" should read -- covered --.

Signed and Sealed this

Eighth Day of February, 2005

JON W. DUDAS
*Director of the United States Patent and Trademark Office*